US006769641B2

(12) United States Patent
Pariseau et al.

(10) Patent No.: US 6,769,641 B2
(45) Date of Patent: Aug. 3, 2004

(54) SEGMENTED RING GUIDE FOR ROLLING MILL LAYING HEAD

(75) Inventors: David L. Pariseau, Charlton, MA (US); Kenneth Plante, Holden, MA (US)

(73) Assignee: Morgan Construction Company, Worcester, MA (US)

( * ) Notice: Subject to any disclaimer, the term of this patent is extended or adjusted under 35 U.S.C. 154(b) by 0 days.

(21) Appl. No.: 10/313,938

(22) Filed: Dec. 6, 2002

(65) Prior Publication Data

US 2003/0122017 A1 Jul. 3, 2003

Related U.S. Application Data

(60) Provisional application No. 60/340,180, filed on Dec. 14, 2001.

(51) Int. Cl.[7] ..... B21C 47/14

(52) U.S. Cl. ..... 242/361; 72/66

(58) Field of Search ..... 242/361, 361.1, 242/361.2, 361.3, 361.4, 361.5; 72/66, 135

(56) References Cited

U.S. PATENT DOCUMENTS 4,074,553 A * 2/1978 Woodrow ..... 72/66
4,242,892 A 1/1981 Wykes et al.
5,312,065 A 5/1994 Shore et al.

FOREIGN PATENT DOCUMENTS

EP 0 554 976 A1 8/1993
JP 08215751 8/1996

* cited by examiner

*Primary Examiner*—John M. Jillions
(74) *Attorney, Agent, or Firm*—Gauthier & Connors

(57) ABSTRACT

A laying has a quill rotatable about an axis, and a pipe carried on the quill. The pipe has an entry end arranged to receive a product, and an intermediate portion defining a curved guide path leading from the entry and to a delivery end spaced radially from the quill axis and from which the product is discharged as a helical series of rings. A guide defines a helical extension of the guide path, and comprises a helical support plate projecting outwardly from the quill. A plurality of channel-shaped guide sections supported end to end on the support plate. The guide sections form a segmented radially outwardly facing helical trough surrounded by a cylindrical shroud that cooperates with the guide sections to definee radially and axially confined helical extension of the guide path.

10 Claims, 5 Drawing Sheets

SEGMENTED RING GUIDE FOR ROLLING MILL LAYING HEAD

CROSS REFERENCE TO RELATED APPLICATION

This application claims priority of provisional patent application Serial No. 60/340,180 filed on Dec. 14, 2001.

BACKGROUND OF DISCUSSION

1. Field of the Invention

This invention relates to high speed rod rolling mills, and is concerned in particular with an improvement to the laying heads employed in such mills to form the hot rolled product into a series of rings.

2. Description of the Prior Art

With reference to FIG. 1, a typical laying head includes a housing 10 containing a rotatably driven hollow quill 12. A three dimensionally curved laying pipe 14 is carried by the quill 12. The laying pipe has an entry end 14*a* aligned with the rotational axis X of the quill, and a curved intermediate section 14*b* leading to a delivery end 14*c* spaced radially from axis X.

Hot rolled steel rod is delivered to the entry end 14*a* of the delivery pipe along axis X, and exits from the delivery end 14*c* as a helical formation of rings.

Upon exiting from the delivery end 14*c* of the laying pipe, the rings are additionally confined and moved forward by a helical trough 16 surrounded by a cylindrical shroud 18.

The guide trough 16 is configured and dimensioned to coact with the shroud 18 in providing an axially and radially confined helical extension of the guide path defined by the laying pipe. Although this extended confinement has proven to be highly beneficial in resisting distortion and kinking of the tail ends of products passing through the laying head, the unitary construction of the guide trough has given rise to certain difficulties. For example, the materials that can be readily formed or machined into a helical configuration are relatively soft and thus prone to accelerated wear caused by frictional contact with the hot rolled product. Although accelerated frictional wear typically occurs only locally along short sections of the guide path, the entire trough must be replaced when the affected sections are no longer serviceable. Also, since the dimensions of the guide trough are selected to closely confine a particular product size, a change in the rolling schedule to a different product size will usually require replacing the entire guide trough with another trough properly dimensioned to handle the.

SUMMARY OF THE INVENTION

In accordance with the present invention, the known unitary guide trough is replaced by a plurality of channel-shaped guide sections carried on the periphery of a helical support plate. The guide sections are preferably identical, spaced one from the other, and removably secured to the support plate. With this arrangement, the support plate may be fabricated from one material selected for it strength and formability, e.g., ASTM A502, and the guide sections may be cast or machined from a different material selected for its resistance to frictional wear, e.g., ASTM 4140. Guide sections that undergo accelerated wear can be replaced while allowing the others to remain in place for continued extended use. A change in product size can be readily accommodated by simply changing only the guide sections without having to also replace the helical support plate.

These and other features and advantages of the present invention will now be described in greater detail with reference to the accompanying drawings, wherein:

DETAILED DESCRIPTION OF PREFERRED EMBODIMENT

Figure 1:
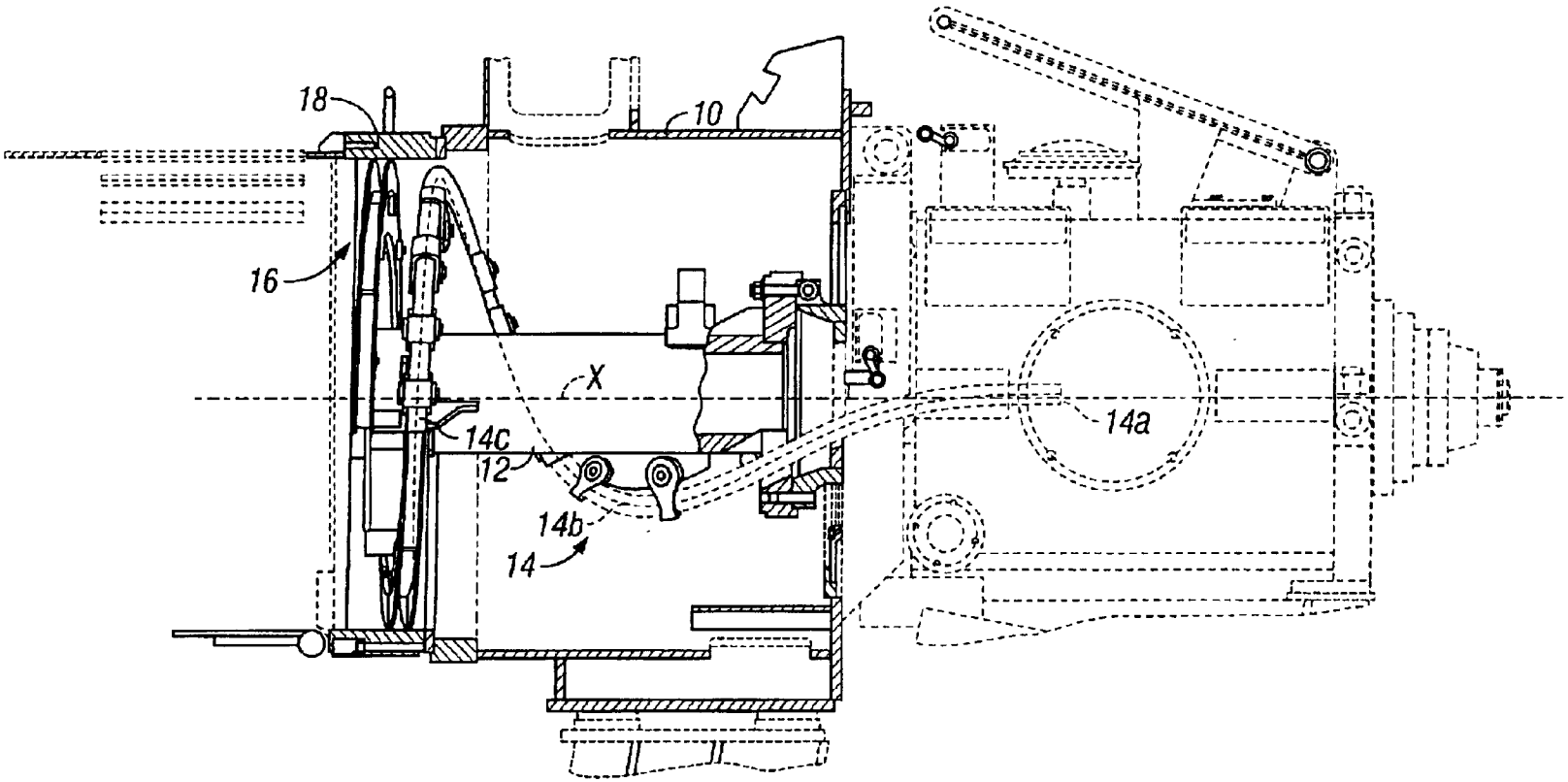
FIG. 1 (Prior Art)
FIG. 1 is a partially sectioned side view of a typical laying head.
Figure 2:
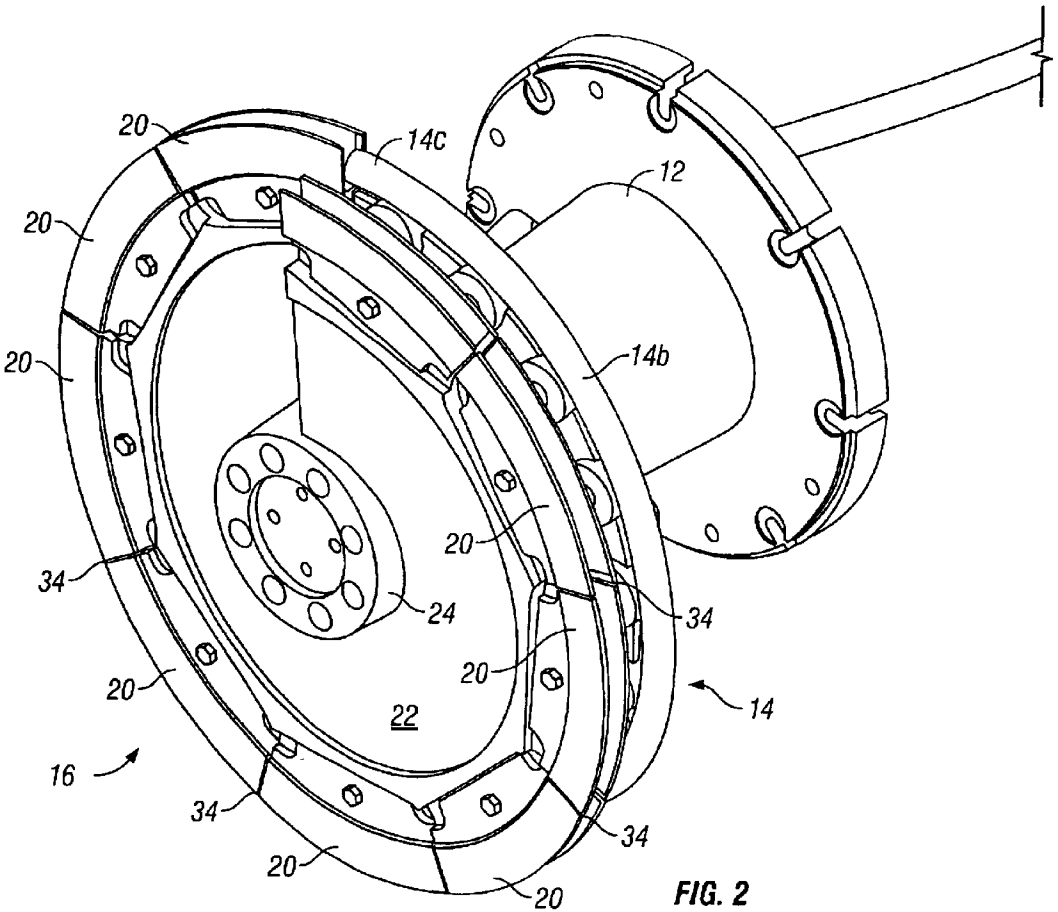
FIG. 2 is a perspective view of the laying head quill and laying pipe equipped with a helical outport plate and segmented guide trough in accordance with a preferred embodiment of the present invention.

It will be seen by additional reference to FIG. 2 that a helical trough 16' in accordance with the present invention is made up of channel-shaped guide segments 20 supported end-to-end on a helical support plate 22 having a hub 24 removably secured to the end of the quill 12.

Figure 3:
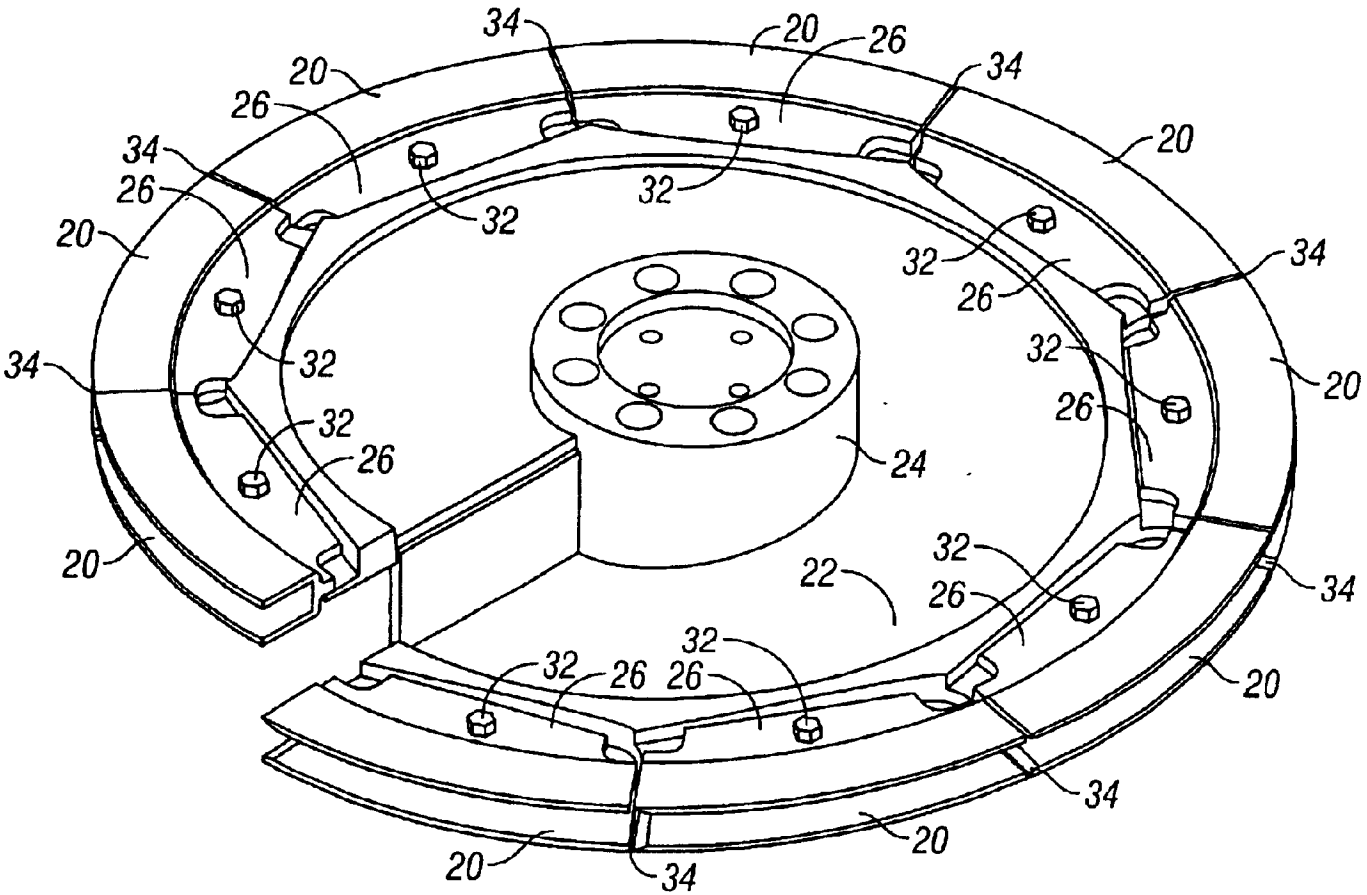
FIG. 3 is a perspective view of the segmented guide trough and helical support plate.
Figure 4:
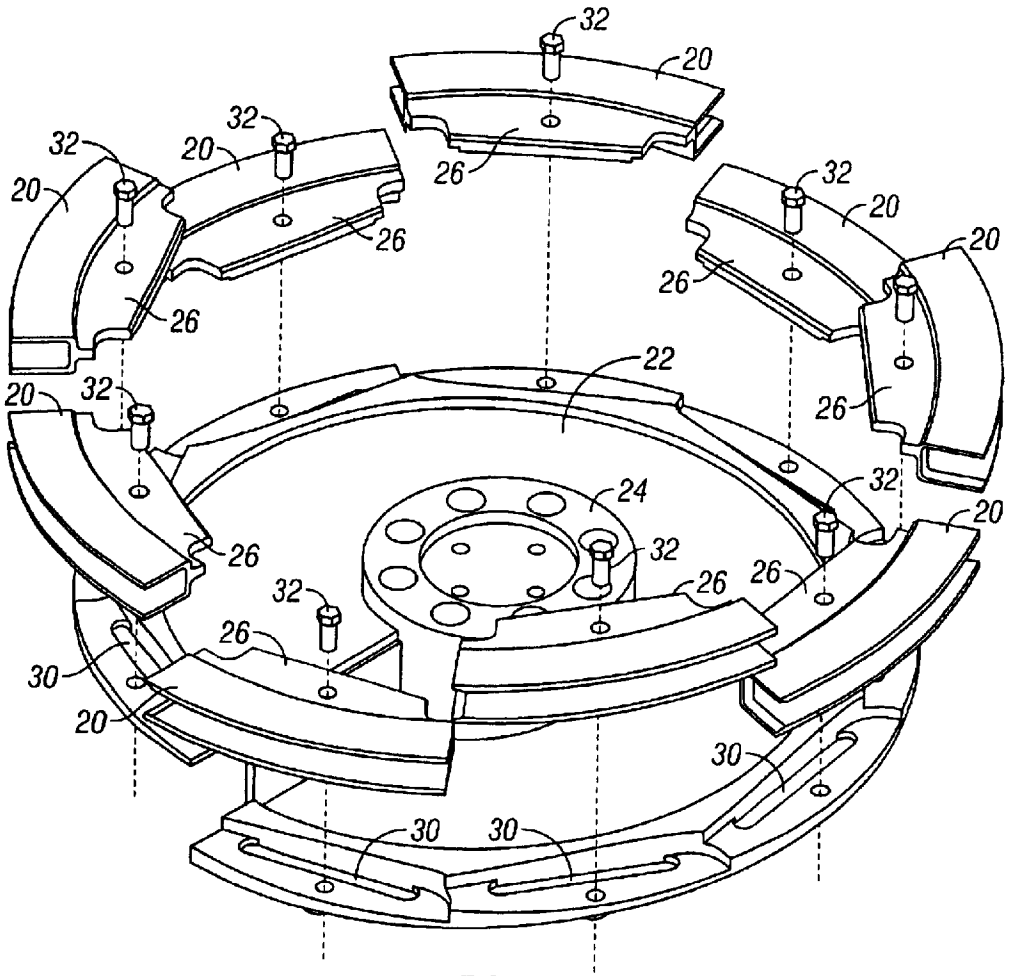
FIG. 4 is an exploded perspective view of the components shown in FIG. 3.
Figure 5:
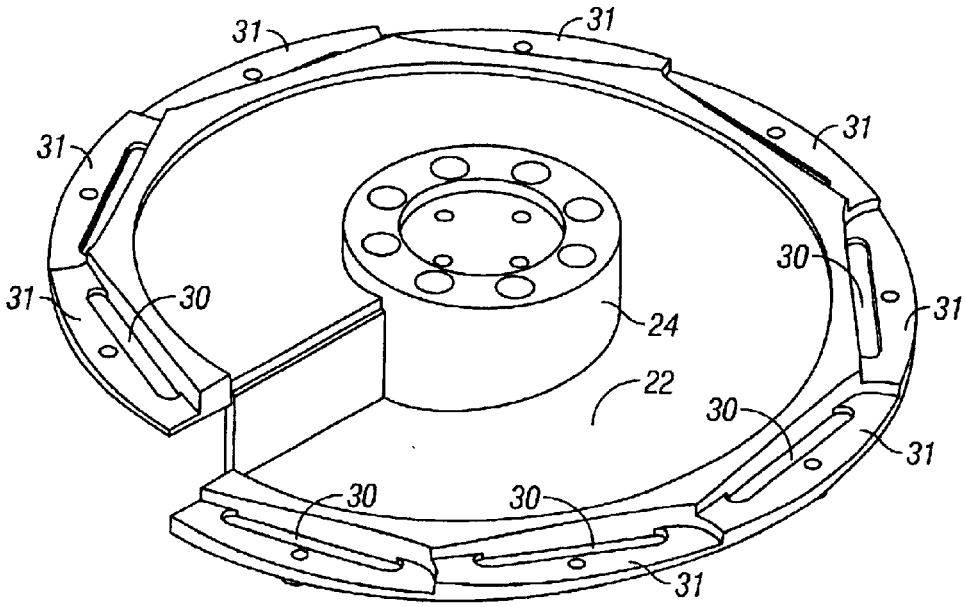
FIG. 5 is a perspective view of the helical support plate.
Figure 6:
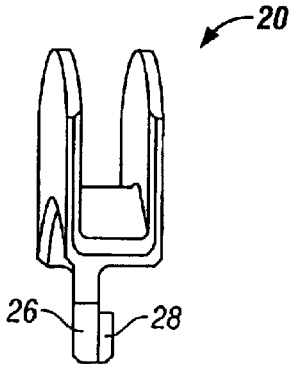
FIG. 6 is an end view of one of the trough segments.

FIG. 3 shows the assembly of the helical support plate 22 and guide segments 20 removed from the quill, FIG. 4 is an exploded view of the components of the assembly, FIG. 5 shows the helical support plate 22 by itself, and FIG. 6 shows an end view of a typical guide segment. The individual guide segments 20 have generally U-shaped guide channels with mounting flanges 26. The mounting flanges 26 are angularly offset with respect to their respective guide channels, and are advantageously provided with laterally projecting shoulders 28 configured and dimensioned to be seated in locating grooves 30 in flat recessed mounting surfaces 31 located around the flank of the helical support plate 22. The guide segments are removably attached centrally by bolts 32 or the like, and are preferably spaced one from the other as shown in FIGS. 2 and 3 at 34 in order to accommodate thermal expansion.

The guide segments 20 may comprise dimensionally accurate investment castings, cast from light weight materials, e.g., titanium. The guide segments may also be provided with wear and heat resistant ceramic liners.

When individual guide segments experience accelerated wear, they may be replaced without replacing those that experience lesser wear. Also, when a different product size is being rolled, only the guide segments need to be changed.

We claim:

1. A laying head for forming an axially moving elongated product into a helical series of rings, said laying head comprising:

a quill rotatable about an axis;

a pipe carried on said quill, said laying pipe having an entry end aligned with said axis and arranged to receive said product, and having an intermediate portion defining a curved guide path leading from said entry end to a delivery end spaced radially from said axis and from which said product is discharged as said helical series of rings;

a helical support plate projecting outwardly from said quill;

a plurality of channel-shaped guide sections supported end to end on and removably secured to said support plate, said guide sections forming a segmented radially outwardly facing helical trough; and a cylindrical shroud surrounding and cooperating with said guide sections to define a radially and axially confined helical extension of said guide path.

2. The guide of claim 1 wherein said guide sections are removably secured to said helical support plate.

3. The laying head of claim 1 wherein said guide sections are spaced one from the other along the periphery of said support plate.

4. The laying head of claim 3 wherein said guide sections are provided with flanges protruding radially inwardly along a flank of said support plate, and wherein said flanges are secured centrally to said flank.

5. The laying head of claim 4 wherein said flank has flat mounting surfaces against which said flanges are secured.

6. The laying head of claim 5 wherein said flanges are provided with bosses projecting laterally into grooves in said flat mounting surfaces.

7. The laying head of claim 1 wherein said guide segments are identical and interchangeable one for the other.

8. The laving head of claim 1 wherein said guide segments are formed from a material which has a greater resistance to frictional wear as compared to the resistance to frictional wear of the material of said support plate.

9. The laying head of claim 1 wherein said support plate is removably secured to said quill.

10. The laying head of claim 4 wherein said flanges are angularly offset with respect to the respective guide sections.

* * * * *